United States Patent [19]

Gohara et al.

[11] Patent Number: 5,025,762

[45] Date of Patent: Jun. 25, 1991

[54] TWO CYCLE ENGINE FOR SMALL BOAT

[75] Inventors: Yoshihiro Gohara; Masaharu Miyazaki, both of Hamamatsu, Japan

[73] Assignee: Sanshin Kogyo Kabushiki Kaisha, Hamamatsu, Japan

[21] Appl. No.: 561,150

[22] Filed: Aug. 1, 1990

[30] Foreign Application Priority Data

Aug. 1, 1989 [JP] Japan ..... 1-197997

[51] Int. Cl.[5] ..... F01M 1/00

[52] U.S. Cl. ..... 123/196 S; 417/500; 184/6.28

[58] Field of Search ..... 123/196 R, 196 S; 417/500; 184/6.28

[56] References Cited

U.S. PATENT DOCUMENTS 4,787,832 11/1988 Fukasawa et al. ..... 417/500
4,971,532 11/1990 Slattery ..... 417/500

FOREIGN PATENT DOCUMENTS 117369 7/1983 Japan ..... 417/500
62-50295 3/1987 Japan .
62-191672 8/1987 Japan .

*Primary Examiner*—E. Rollins Cross
*Attorney, Agent, or Firm*—Ernest A. Beutler

[57] ABSTRACT

A number of embodiments of lubricating systems for small watercraft that might become inverted and wherein a lubricant reservoir supplies lubricant under gravity to a lubricant pump when the water pump is operating in a normal upright condition. An air return line extends from the lubricant pump back to the reservoir to pump air which may enter the lubricant pump back to the reservoir. Arrangements are provided for insuring that air cannot flow from the lubricant reservoir to the lubricant pump through the supply line when the watercraft is inverted and also for precluding lubricant pressure in the air return line from acting to force air back to the lubricant pump when the watercraft is inverted.

16 Claims, 6 Drawing Sheets

TWO CYCLE ENGINE FOR SMALL BOAT

BACKGROUND OF THE INVENTION

This invention relates to a two cycle engine for a small boat and more particularly to an improved lubricating system for the two cycle engine of a small boat.

As is well known, a wide variety of watercraft are provided with internal combustion engines for powering the watercraft. In connection with the use of an internal combustion engine, it is also the practice to provide a lubricating system for the engine. With two cycle engines, although it has been the practice to mix lubricant with the fuel for the engine, there are a number of advantages to employing a separate lubricating system wherein lubricant is supplied to the engine from a separate lubricant reservoir. In many of these types of lubricating systems, the lubricant reservoir is positioned vertically above the lubricant pump when the watercraft is operating in its normal upright condition so that lubricant will be supplied to the pump under the influence of gravity. With many types of watercraft, particularly those having a highly sporting nature such as some small jet propelled watercraft that are designed to be operated by a rider wearing a swimming suit, it is anticipated that the watercraft will become inverted during its operation.

When the engine is provided with a lubricating system of the type having the lubricant reservoir positioned above the lubricant pump, the inversion of the watercraft can cause air to flow from the reservoir to the pumping system When this occurs and the watercraft is righted, if the engine is restarted immediately, the lubricant pump will pump air rather than lubricant to the engine. Obvious problems can occur when this happens.

There have been proposed lubricant pumping systems wherein the lubricant pump is provided with a self purging device that will purge air from the lubricant and return it back to the lubricant reservoir through an air return line. With such systems, inversion of the watercraft can also give rise to problems. That is, the return line can become filled with air and when the watercraft is inverted, lubricant can become forced in the line along with the air. When the watercraft is righted, the lubricant in the return line can actually force air back into the lubricant pump and the aforenoted problems will again be possible.

It is, therefore, a principal object of this invention to provide an improved lubricating system for the internal combustion engine of a small watercraft wherein it will be insured that inversion and righting of the watercraft will not cause the lubricant system to deliver air to the engine rather than lubricant.

It is a further object of this invention to provide a lubricating system for a small watercraft of the type having the lubricant reservoir above the lubricant pump and incorporating an arrangement for insuring that air cannot be delivered to the lubricant pump when the watercraft is inverted and then righted.

It is a further object of this invention to provide an arrangement for purging the air from a lubricating system of a small watercraft and wherein the air purging return line will not cause air to be forced back into the lubricant pump if the watercraft is inverted and then righted.

SUMMARY OF THE INVENTION

This invention is adapted to be embodied in a lubricating system for a small watercraft powered by an internal combustion engine having a lubricant pump for pumping lubricant to the engine and a lubricant reservoir positioned at a higher vertical level than the lubricant pump when the watercraft is in its normal upright condition for flow of lubricant from the reservoir to the lubricant pump. A conduit is provided for interconnecting the lubricant reservoir and the lubricant pump. In accordance with the invention, means are provided for precluding air to pass from the conduit into the lubricant pump in conditions when the watercraft ma be inverted and subsequently righted.

DETAILED DESCRIPTION OF THE PREFERRED EMBODIMENTS OF THE INVENTION

Figure 1:
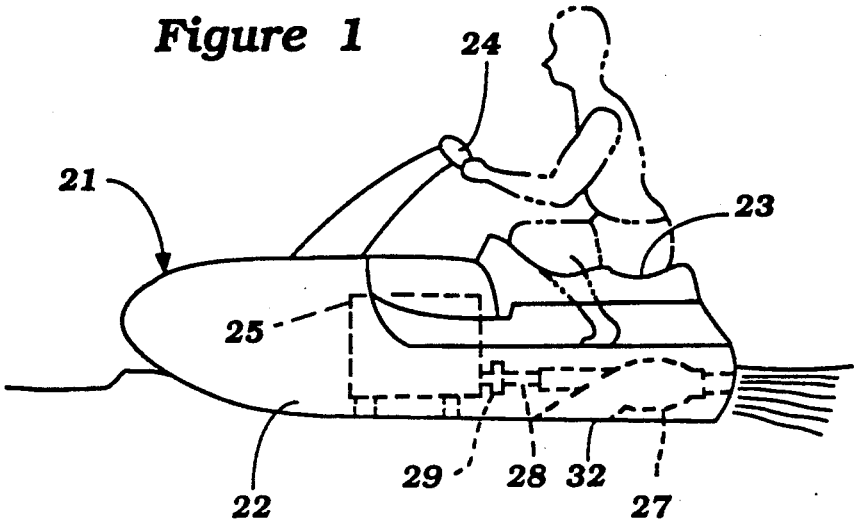
FIG. 1 is a side elevational view of a small watercraft constructed in accordance with an embodiment of the invention.

Before dealing directly with the specific preferred embodiments of the invention, the general environment in which the invention may be employed will be described by reference to FIGS. 1 through 7 with initial description being directed toward FIGS. 1 and 2. As may be seen in these figures, a small watercraft of the type with which the invention has particular utility is indicated generally by the reference numeral 21. The watercraft 21 has a hull 22 that is provided with a rearwardly positioned seat 23 that is adapted to accommodate a single rider, shown in phantom in FIG. 1, seated in straddle fashion. A mast 24 is positioned in front of the rider's seat 23 and contains certain controls for the watercraft such as the steering mechanism, throttle control and starting arrangement.

An engine compartment is provided in the hull 22 forwardly of the rider's seat 23 and contains an internal combustion engine, indicated generally by the reference numeral 25 and having a construction as will be described by reference to FIGS. 2 through 4. Basically the engine 25 is a two cylinder in line reciprocating engine operating in accordance with the two stroke crankcase compression principal. Of course, the invention can be utilized in conjunction with engines having other numbers of cylinders and operating on other principles and in fact engines other than reciprocating engines. The invention has particular utility in conjunction with engines of the type having separate lubricating systems including a lubricant reservoir and a lubricant pump, as will be described. Two cycle engines are normally of this type.

To the rear of the engine compartment and beneath the seat 23, the hull 22 is formed with a tunnel portion 26 in which a jet propulsion unit 27 is positioned. The jet propulsion unit 27 has a drive shaft 28 that is coupled through a coupling 29 to the crankshaft (to be described later) of the engine 25.

The jet propulsion unit 27 is of a typical type and includes an impeller housing 31 having an impeller 32 that draws water from a downwardly facing water inlet 33 and which driven by the drive shaft 28. The pressurized water is discharged past straightening vanes 34 through a steering nozzle 35 for powering the watercraft 21 and for steering of it in a well known manner.

Figure 2:
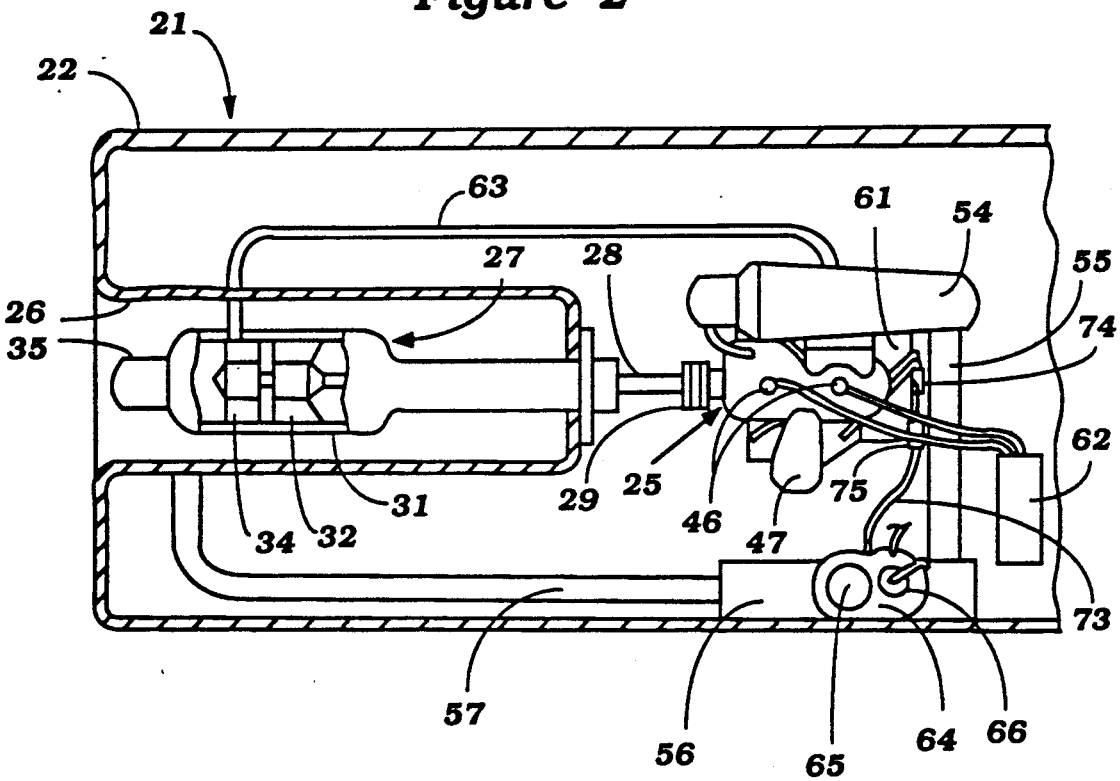
FIG. 2 is a top plan view of a portion of the watercraft, with portions shown in section.
Figure 3:
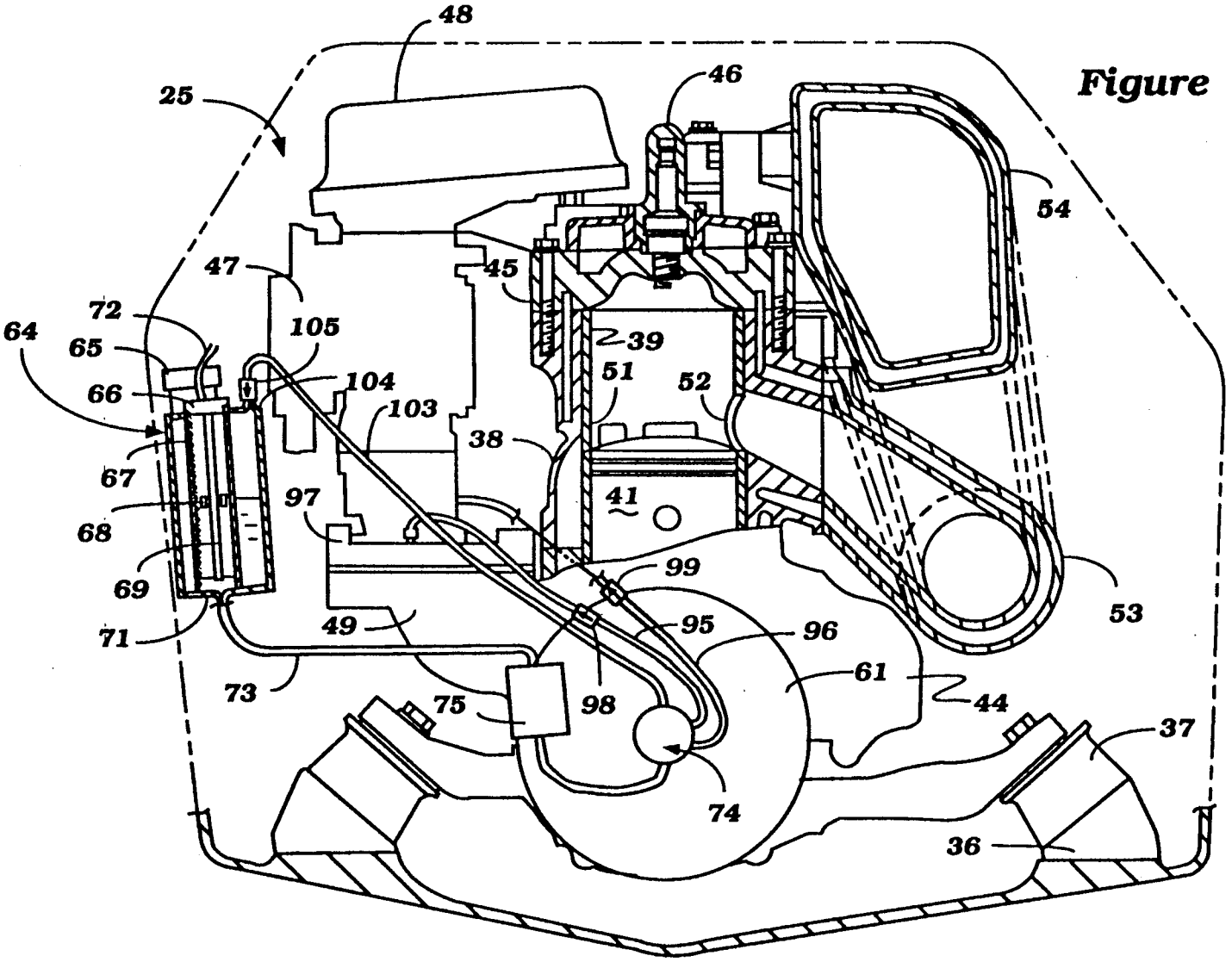
FIG. 3 is a front elevational view of the watercraft, with portions shown in phantom and other portions broken away and shown in section.
Figure 4:
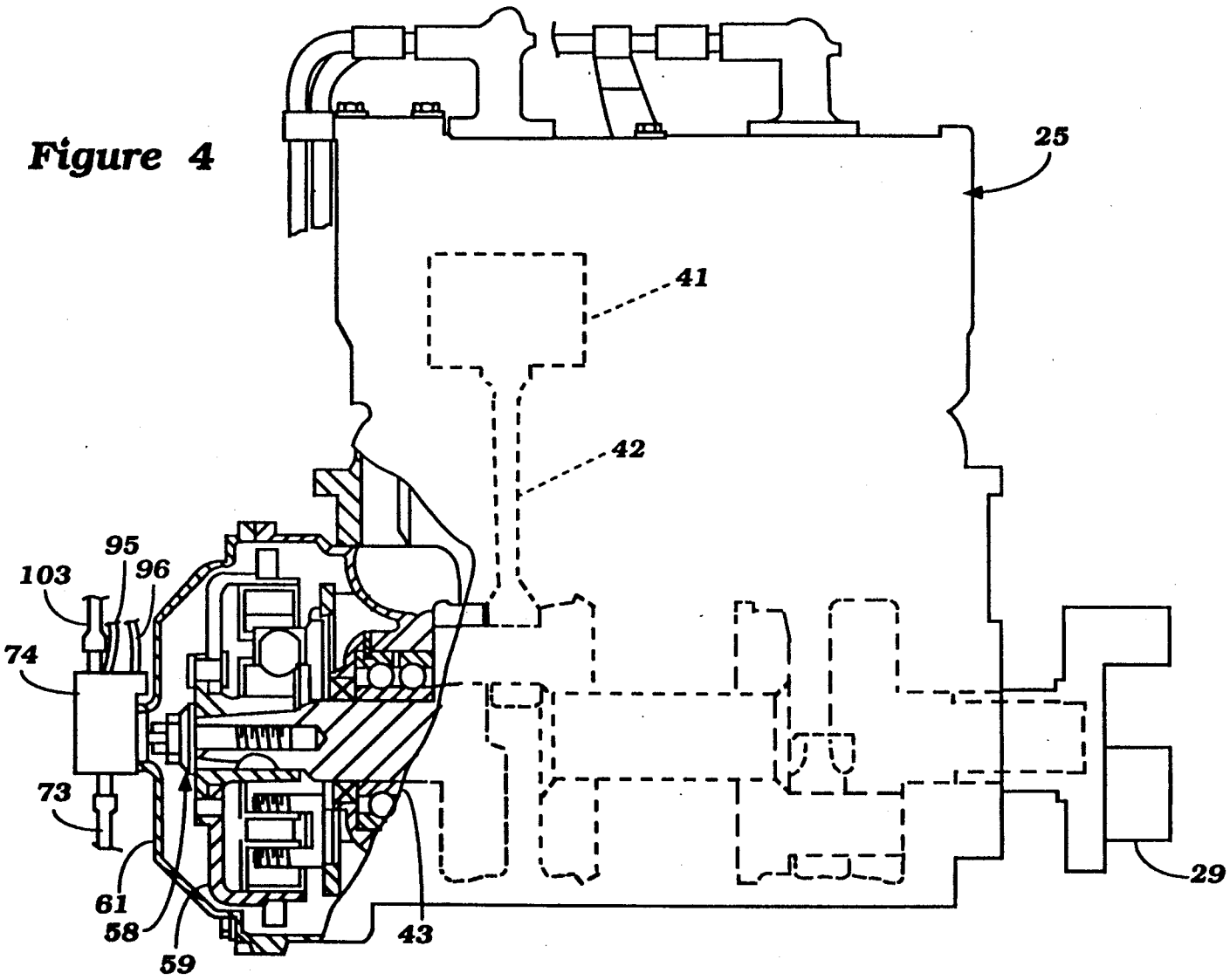
FIG. 4 is an enlarged side elevational view of the engine for the watercraft, with a portion broken away to show the construction of the lubricant pump.

Referring now in detail primarily to FIGS. 2 through 4, the engine 25 is mounted within the hull 22 on mounting bosses 36 by means of elastic supports 37.

The engine 25 includes a cylinder block 38 in which cylinder liners 39 are positioned so as to slidably support pistons 41. The pistons 41 are connected by means of connecting rods 42 to a crankshaft 43 that is journaled within a crankcase formed by the cylinder block 38 and a crankcase member 44 that is affixed to thereto.

A cylinder head 45 is affixed appropriately to the cylinder block 38 and contains combustion chambers in which spark plugs 46 are mounted.

As is well known in two cycle engine practice, the crankcase of the engine is divided into individual chambers which are sealed from each other and a fuel air charge is delivered thereto from carburetors 47 that draw air from an air inlet device 48 and which discharge into a manifold assembly 49. Check valve assemblies (not shown) are positioned in the manifold 49 for precluding reverse flow of fuel air from the crankcase chambers back to the carburetors 47.

The charge which has been admitted to the crankcase chambers is transferred through scavenge ports 51 into the combustion chambers for firing by the spark plugs 46. The burnt charge is then exhausted through exhaust ports 52 into a water jacketed exhaust manifold 53 and expansion chamber 54. An exhaust pipe 55 then conveys the exhaust gases to a further silencing and water discharge device 56. The exhaust gases and water then flow through an exhaust discharge conduit 57 for discharge into the tunnel 26.

The magneto generator, indicated generally by the reference numeral 58 and which includes a flywheel 59 is affixed to the forward end of the crankshaft 45 and is contained within a cover plate 61. This magneto generator 58 supplies electrical power to the accessories of the watercraft and also to a spark control circuit 62 which is mounted in a watertight box and which fires the spark plugs 46 in a known manner.

The engine 25 is water cooled and coolant is supplied to the cooling jacket from the jet propulsion unit 27 through a conduit 63 that has its inlet end positioned adjacent the impeller 34. This coolant is then circulated through the cooling jacket of the engine and discharged through its exhaust system and the cooling jackets around the manifold 53 and expansion chamber 54 for redischarge back into the body of water in which the watercraft is operating.

The construction of the watercraft and engine as thus far described may be considered to be conventional and, for that reason, further description is believed to be necessary. Also, as has been previously discussed, the construction is typical only of the environment in which the invention may be employed and various other known structures may be utilized in conjunction with the invention.

In accordance with the invention, the engine 25 is provided with a separate lubricating system for lubricating the engine and which avoids the necessity of mixing lubricant with the fuel for the engine, as is conventional with many types of two cycle engines. This separate lubricating system includes a lubricant reservoir 64 that is mounted within the watercraft hull 22 at an elevated condition relative to the engine crankshaft 45. The lubricant reservoir 64 has an internal cavity to which lubricant may be added through a fill neck on which a closure cap 65 is provided.

A liquid level sensing mechanism 66 is contained within the reservoir 64 and includes an exterior screen portion 67 of a tubular configuration in which a float 68 is slidably supported on a rod 69. The float 68 cooperates with a magnet or other assemblies (not shown) so as to provide an output signal through conductors 72 that can provide a variety of functions such as the warning or level indication to the operator and which may also be cooperating with a protection circuit embodied in the spark control system 62 for slowing or stopping the speed of the engine 25 in the event the lubricant level in the reservoir 64 becomes dangerously depleted.

A discharge fitting 71 is provided in the reservoir 64 at the lower end thereof and centrally within the screen 67 so that the lubricant flowing from the reservoir 64 will be filtered. A supply conduit 73 delivers lubricant from the discharge fitting 71 to an engine driven lubricant pump 74. An air trap device, indicated generally by the reference numeral 75 and having a construction as will be hereinafter described, is provided in the conduit 73 for precluding the flow of air through the conduit 73 from the reservoir 64 to the lubricant pump 74 in the event the watercraft 21 becomes inverted.

Figure 5:
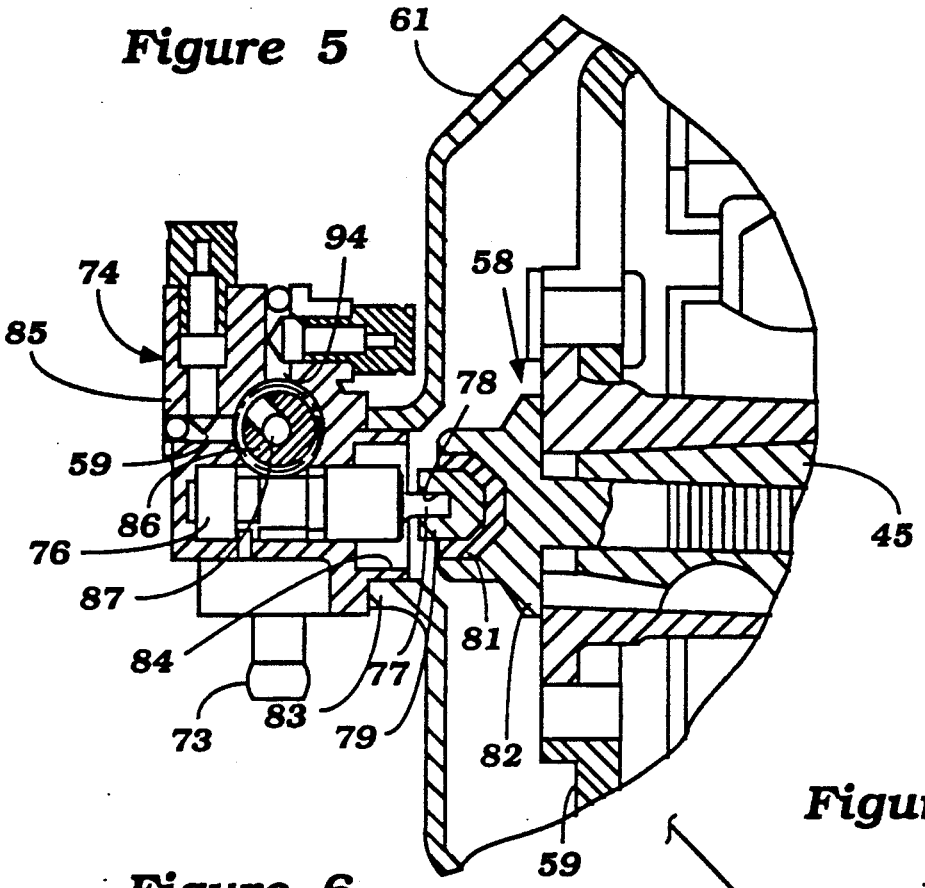
FIG. 5 is an enlarged cross sectional view, taken generally in the same direction as FIG. 4, but showing the lubricant pump and its driving relationship with the engine and is taken generally along the line 5—5 of FIG. 6.
Figure 6:
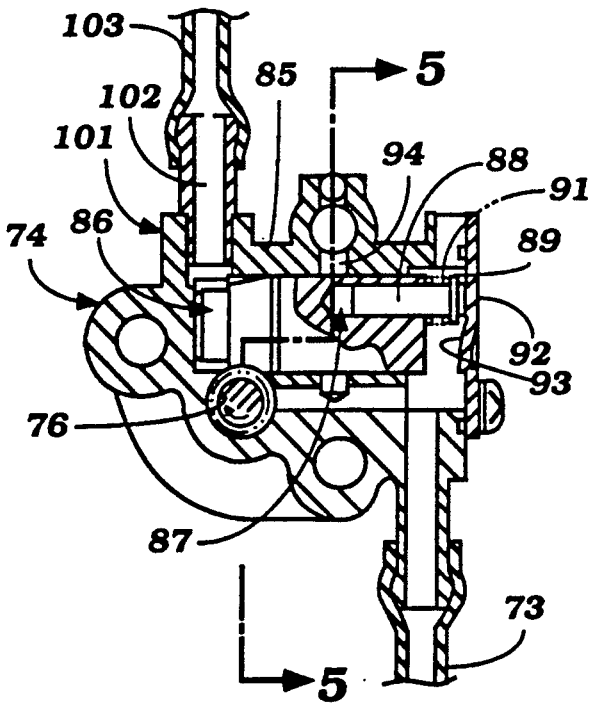
FIG. 6 is an enlarged cross sectional view taken along a plane extending perpendicular to the plane of FIG. 5.
Figure 7:
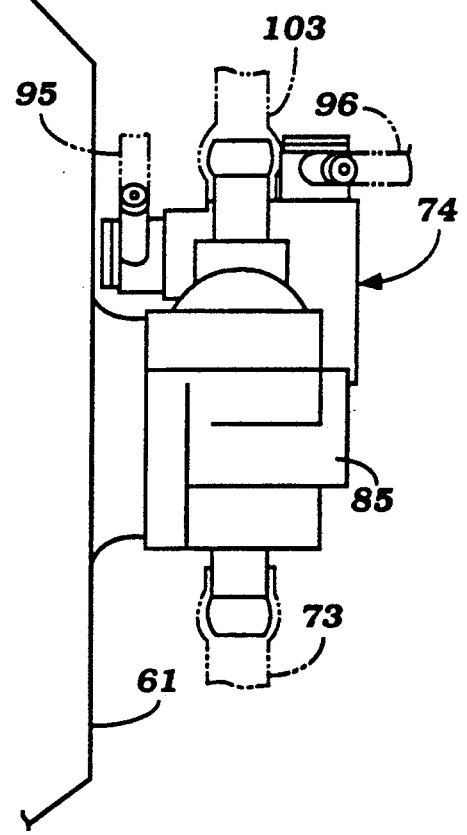
FIG. 7 is a side elevational view, in part similar to FIG. 5 but looking in the opposite direction.

Referring now primarily to FIGS. 5 through 7, the pump assembly 74 includes a pump drive shaft 76 that has a key portion 77 that is received within a complementary socket 78 formed in a drive member 79 that is affixed by means of an elastic member 81 to a drive coupling 82 that is affixed to the forward end of the crankshaft 45. The front cover 61 has a forwardly extending cylindrical portion 83 that receives a sleeve portion 84 of the housing 85 of the pump assembly 74 for affixing the pump assembly 74 to the front cover 61.

The pump drive shaft 76 is formed with an integral drive gear portion that is enmeshed with a corresponding gear formed on a pump operating member 86 for driving the pump operating member 86 for rotation about an axis that extends transversely to the axis of the pump drive shaft 76. The pump driving member 86 is provided with one or more pumping bores 87 in which pumping plungers 88 are received. These pumping plungers 88 have headed portions 89 that are urged by springs 91 into engagement with a cam plate 92 on which camming surfaces 93 are provided. As a result, upon rotation of the pump driving member 86, the pumping members 88 will reciprocate in the pumping chambers 87 and sequentially pressurize lubricant therein which has been supplied to the supply conduit 73 and discharge the lubricant through discharge ports 94 that supply lubricant through a plurality of conduits 95 and 96 that extend to areas of the engine 25 to be lubricated. In the illustrated embodiment, the conduits 95 and 96 extend to a spacer plate 97 that is interposed between the carburetors 47 and manifold 49 so that the lubricant will be delivered along with the fuel air mixture to the crankcase chamber. Of course, other types of delivery systems can be employed and the lubricant can be delivered in addition to the intake manifold directly to the parts of the engine to be lubricated. Check valves 98 and 99 are positioned in the conduits 95 and 96 so as to insure against any air flow back to the lubricant pump assembly 74 from the manifold.

An air bleed port 101 is provided at an area at the upper portion of the pump housing 85 and has a discharge pipe 102 affixed to it that receives a flexible conduit 103. Any air which may become entrapped in the pump assembly will be discharged through the conduit 103 back to an area above the lubricant in the reservoir 64 through an air admission nipple 104 formed in the upper wall thereof. This automatic air purging system also includes, in accordance with an embodiment of the invention, a lubricant return preventing device, indicated generally by the reference numeral 105 and having a construction as will be described. The device 105 prevents lubricant from being forced into the conduit 103 if the watercraft 21 is inverted. Such lubricant return into the conduit 103 would force air back into the lubricant pump 74 and cause the aforenoted deleterious effect.

Figure 8:
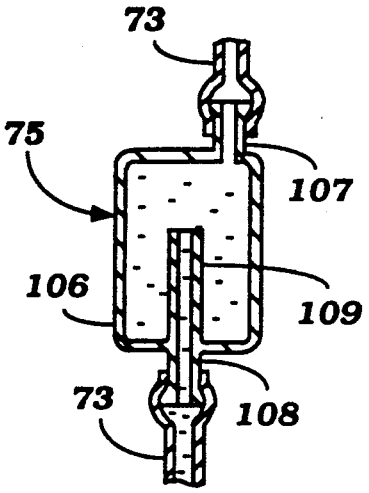
FIG. 8 is a cross sectional view taken through the air reentry prevention device constructed in accordance with a first embodiment of the invention and showing the condition when the watercraft is operating in a normal upright condition.
Figure 9:
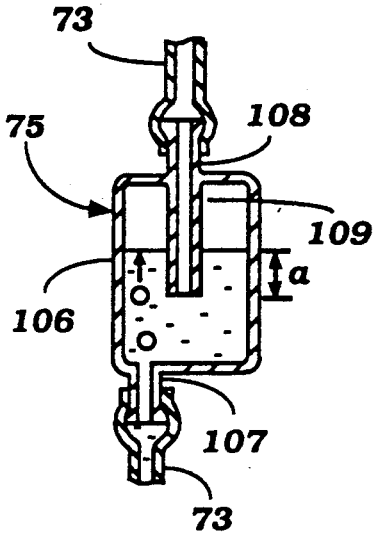
FIG. 9 is a cross sectional view, in part similar to FIG. 8, and shows the construction when the watercraft is inverted and the manner in which the entry of air is precluded.

As should be readily apparent, during extending running of the engine 25 the consumption of lubricant from the reservoir 64 will cause the level to fall and air will enter the displaced area through a suitable vent passage (not shown) such as a vent in the filler cap 65. This is no problem and is necessary for proper operation. However, when the watercraft 21 becomes inverted in use, as is possible, the air that is at the top of the reservoir 64 will then move to the bottom and will tend to flow upwardly through the conduit 73 as lubricant drains back from the pump 74. It is important to insure that this air does not enter the lubricant pump 74 for the reasons as aforenoted. The trap device 75 functions to prevent this. How this is done will now be explained by reference to FIGS. 8 and 9. FIG. 8 shows the construction in the normal upright position, while FIG. 9 shows the condition when the watercraft 21 is inverted.

The trap device 75 is, in the illustrated embodiment, comprised of a cylindrical outer body 106 having an inlet fitting 107 and an outlet fitting 108 at its upper and lower ends in the normal orientation. The outlet fitting 108 has an extension portion 109 that extends into the hollow interior of the cylindrical body 106 and terminates somewhere near its midpoint. When the watercraft is operating in its normal condition, the cylindrical body 106 will be fully filled with lubricant as long as the reservoir 64 does not become depleted (FIG. 8).

When the watercraft 21 becomes inverted, however, the lubricant which was previously at the outlet fitting 71 of the reservoir 64 will flow toward the cap end and air will be displaced adjacent the fitting 71. This air tends to move upwardly through the conduit 73 to the inlet fitting 107. However, a trap will be formed by the volume of the housing 106 and the air that flows into the housing 106 will not immediately enter the portion of the conduit 73 leading to the pump 74 due to the extension of the portion 109 into the interior as shown in FIG. 9. Hence, there will be a delay before any air can reach the pump 74. That is, the lubricant must flow out of the housing 106 to the depth indicated by the dimension a in FIG. 9 before air can flow directly into the conduit 73 and then to the pump 74. As a result, by the time the watercraft has been righted, it will be readily insured that no air can reach the pump 74. As a result, on restarting of the engine, there will be lubricant immediately delivered to the engine by the pump 74 rather than air.

When the watercraft is righted, the air which has been trapped in the housing 106 will gradually flow out of the inlet conduit 107 and back to the reservoir 64.

Figure 10:
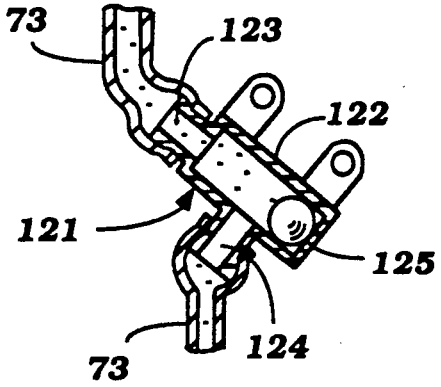
FIG. 10 is a cross sectional view, in part similar to FIGS. 8 and 9, showing another embodiment of the invention.

FIG. 10 shows another embodiment of the invention in which a trap device in the form of a gravity operated check valve, indicated generally by the reference numeral 121 is placed in the conduit 73 between the reservoir 64 and the pump 74. This device 121 includes a housing 122 having an inlet fitting 123 that communicates with the portion of the conduit 73 leading from the tank 64. An outlet fitting !24 intersects the housing 122 at a point above its lower end when in the upright position and communicates with the portion of the conduit 73 leading to the pump 74. A ball type check valve 125 normally lies in the lower portion of the housing 122 below the outlet fitting 124 as seen in FIG. 10.

In the event, however, the watercraft 21 is inverted, the ball 125 will roll from the position shown in FIG. 10 to a position wherein it engages the inlet fitting 123 and forms a closure therefor. Lubricant which was previously in the portion of the conduit 73 leading to the pump 74 will fill the housing 122 and the weight of it will act against the ball 125 to hold the ball in a closed position and to prevent air from entering into the housing 122 and passing to the pump 74.

Figure 11:
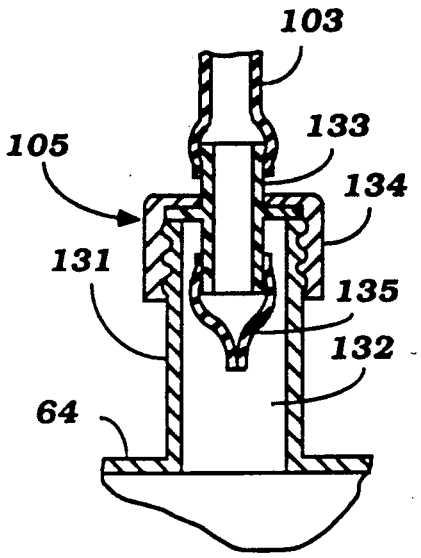
FIG. 11 is a cross sectional view of the upper portion of the lubricant reservoir and shows the arrangement for precluding the entry of lubricant into the air return line in accordance with an embodiment of the invention.

In addition to the possibility of air entering the lubricant pump 74 through the supply conduit 73 when the watercraft 21 is inverted, there is also a risk that lubricant may flow from the reservoir 64 to the pump 74 when the watercraft is inverted through the vent line 103. This would force air in the vent line back into the lubricant pump 74 as aforenoted. The device 105, as has been previously noted, serves to prevent such an occurrence. FIG. 11 shows an embodiment of construction for the device 105.

It should be noted that the upper portion of the tank 64 has an extending neck 131 that defines a cavity 132 that communicates with the area above the lubricant in the tank 64. A fitting member 133 is held across the upper end of the neck 131 by a cap 134. This fitting has an extending portion that receives the conduit 103 and a portion which extends into the cavity 132. A duckbill type check valve 135 is affixed to this extending portion. The duck bill check valve 135 will permit air to reenter the reservoir 64 through the conduit 103 when the watercraft is in its normal upright position. However, in the event the watercraft 21 becomes inverted, the duckbill check valve 135 will preclude lubricant from entering the conduit 103 and forcing the air therein back to the pump 74.

Figure 12:
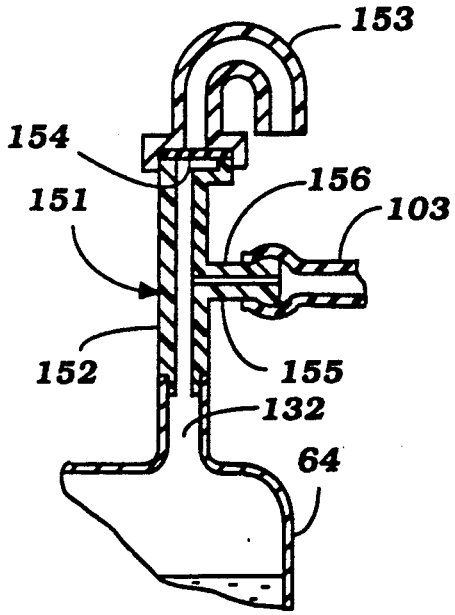

FIG. 12 shows another embodiment of construction, indicated generally by the reference numeral 151 which serves the same function as the check valve 135 of the previously described embodiment. In addition, this construction also functions so as to provide the venting arrangement for the reservoir 64 so as to permit air to enter the reservoir 64 as the lubricant is depleted therein. In this embodiment, the neck 132 has an extending portion 152 which is of a generally T type configuration affixed thereto. A trap like end 153 is connected to the upper end of the portion 152 with a check valve 154 interposed therein. The check valve 154 acts to permit air to enter the reservoir 64 as the lubricant is depleted but will prevent lubricant from flowing out of the trap 153 when the watercraft is inverted. The T member 152 also has an extending leg 155 in which a restricted passageway 156 is formed. The conduit 103 is slipped over this T section leg 155. The restricted orifice 157 will permit air to reenter the tank 64 when the watercraft is in its normal upright condition. However, when the watercraft 21 is inverted, the orifice 156 is small enough to preclude the flow of lubricant. Hence, air in the conduit 103 will not be forced back to the pump 74.

It should be readily apparent from the foregoing description that the described embodiments of the invention are extremely effective in both venting air from the lubricant system when the engine is being operated and the watercraft is at a normal upright condition and also so as to prevent the forcing or delivery of air either through the lubricant supply line or the venting line back to the lubricant pump when the watercraft is inverted. Although a number of embodiments of the invention have been illustrated and described, various changes and modifications may be made without departing from the spirit and scope of the invention, as defined by the appended claims.

We claim:

1. A lubricant system for a small watercraft powered by an internal combustion engine having a lubricant pump for pumping lubricant to said engine, a lubricant reservoir positioned at a higher vertical level than said lubricant pump when said watercraft is in a normal upright condition, conduit means extending between said lubricant reservoir and said lubricant pump and means for preventing air from passing through said conduit means to said pump when said watercraft is inverted and righted.

2. A lubricant system as set forth in claim I wherein the conduit means delivers lubricant from the reservoir to the lubricant pump whenin the upright position and wherein the means for precluding air from passing to the lubricant pump comprises trap means for precluding air from flowing from the lubricant reservoir to the lubricant pump when the watercraft is inverted.

3. A lubricant system as set forth in claim 2 wherein the trap means comprises a volume disposed within the conduit extending between the lubricant reservoir and the pump and having an outlet fitting extending from the lower end of said volume and terminating at a point within the interior of the volume for functioning as a trap when the watercraft is inverted.

4. A lubricant system as set forth in claim 3 further including a return conduit extending from the lubricant pump to the lubricant reservoir for returning air entrapped within the system from the lubricant pump back to the reservoir.

5. A lubricant system as set forth in claim 4 further including means for precluding lubricant from pressurizing the air in the return conduit when the watercraft is inverted so as to prevent air from being forced back to the lubricant pump under the inverted condition.

6. A lubricant system as set forth in claim 5 wherein the means for precluding the lubricant from forcing the air in the return conduit back to the lubricant pump comprises a check valve.

7. A lubricant system as set forth in claim 6 wherein the means for precluding lubricant from forcing air back to the lubricant pump through the return line comprises a, restricted orifice.

8. A lubricant system as set forth in claim 2 wherein the means for preventing air from flowing from the lubricant reservoir to the lubricant pump comprises a gravity operated check valve.

9. A lubricant system as set forth in claim 8 further including a return conduit extending from the lubricant pump to the lubricant reservoir for returning air entrapped within the system from the lubricant pump back to the reservoir.

10. A lubricant system as set forth in claim 9 further including means for precluding lubricant from pressurizing the air in the return conduit when the watercraft is inverted so as to prevent air from being forced back to the lubricant pump under the inverted condition.

11. A lubricant system as set forth in claim 10 wherein the means for precluding the lubricant from forcing the air in the return conduit back to the lubricant pump comprises a check valve.

12. A lubricant system as set forth in claim 10 wherein the means for precluding lubricant from forcing air back to the lubricant pump through the return line comprises a restricted orifice.

13. A lubricant system as set forth in claim 1 wherein the conduit means extends from the lubricant pump to the lubricant reservoir for returning air entrapped within the system from the lubricant pump back to the reservoir.

14. A lubricant system as set forth in claim 13 wherein the means for preventing air from passing to the pump comprises means for precluding lubricant from pressurizing the air in the conduit means when the watercraft is inverted so as to prevent air from being forced back to the lubricant pump under the inverted condition.

15. A lubricant system as set forth in claim 14 wherein the means for precluding the lubricant from forcing the air in the conduit means back to the lubricant pump comprises a check valve.

16. A lubricant system as set forth in claim 14 wherein the means for precluding lubricant from forcing air back to the lubricant pump through the return line comprises a restricted orifice.

* * * * *